US005794107A

United States Patent [19]

Russell

[11] Patent Number: 5,794,107

[45] Date of Patent: Aug. 11, 1998

[54] TONER CONTAINER WITH MOLDED SPRING

[75] Inventor: Robert D. Russell, Pittsford, N.Y.

[73] Assignee: Xerox Corporation, Stamford, Conn.

[21] Appl. No.: 709,897

[22] Filed: Sep. 9, 1996

[51] Int. Cl.[6] ..... G03G 15/08

[52] U.S. Cl. ..... 399/262; 222/DIG. 1

[58] Field of Search ..... 399/262, 263; 222/DIG. 1, 162, 167, 325–327, 336–338, 386.5, 511, 521, 516

[56] References Cited

U.S. PATENT DOCUMENTS

| | | | |
|---|---|---|---|
| 4,417,802 | 11/1983 | Forbes II | 399/258 |
| 4,640,442 | 2/1987 | Drobish | 222/209 |
| 4,878,603 | 11/1989 | Ikesue | 222/167 |
| 4,990,964 | 2/1991 | Kraehn . | |
| 5,057,872 | 10/1991 | Saijo et al. . | |
| 5,060,826 | 10/1991 | Coleman | 222/95 |
| 5,089,854 | 2/1992 | Kaieda et al. . | |
| 5,238,150 | 8/1993 | Williams | 222/95 |
| 5,282,549 | 2/1994 | Scholz et al. | 222/95 |
| 5,435,461 | 7/1995 | Smith et al. | 222/DIG. 1 |
| 5,446,478 | 8/1995 | Larson . | |
| 5,455,662 | 10/1995 | Ichikawa et al. . | |
| 5,495,323 | 2/1996 | Meetze, Jr. . | |
| 5,500,719 | 3/1996 | Ichikawa et al. | 399/238 |
| 5,557,382 | 9/1996 | Tatsumi et al. | 399/262 |

FOREIGN PATENT DOCUMENTS

| | | |
|---|---|---|
| 0452670 | 2/1992 | Japan . |
| 04-362671 | 12/1992 | Japan . |
| 06-59572 | 3/1994 | Japan . |
| 06-214459 | 8/1994 | Japan . |

*Primary Examiner*—Robert Beatty
*Attorney, Agent, or Firm*—John S. Wagley

[57] ABSTRACT

A device for storing a supply of particles for use in a developer unit of an electrophotographic printing machine is provided. The device includes an open ended container defining a chamber in communication with the open end thereof. The particles are stored in the chamber of the container. The device also includes a resilient member cooperating with the container to urge the container in the direction of the open end. The member defines a longitudinal axis and includes conofrustrical shaped segments. The member is collapsible in the direction of the longitudinal axis. The member includes a body defining a cavity therein.

24 Claims, 6 Drawing Sheets

TONER CONTAINER WITH MOLDED SPRING

The present invention relates to a developer apparatus for electrophotographic printing. More specifically, the invention relates to a container for storing toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. When the opening is not in the bottom or the geometry of the container does not promote the free flow of all the contents, a mechanism must be provided for removing the toner therefrom. While the demand for toner remains fairly constant, these mechanisms expel large quantities of toner when the container is full and progressively smaller amounts as the container empties.

Cylindrical toner containers are now available with spiral ribs located therein, which when rotated urge the toner to the end thereof. These containers have an opening in the periphery of the container near one end thereof through which toner escapes. A machine interface which must be sealed to the container is used to remove toner from the opening. Typically the dispensing hole is covered with a removable seal to contain the toner during shipment. The seal is removed prior to installation of the container. An example of a prior art container is shown in U.S. Pat. No. 5,495,323 to Meetze incorporated herein by reference.

The opening of cylindrical toner containers, particularly when spaced in a horizontal attitude, include a resilient seal around the periphery of the opening on one end of the container. The cylindrical toner container thus needs to be urged toward the seal to assure proper sealing of the container. Typically, such urging is performed by a separate coil spring made of a suitable durable material, typically spring steel and is positioned between a member of the development system and the closed end of the container to urge the container against the opposed open end of the container. The use of the coil spring adds an additional component and its related expense as well as a loose piece that may be lost during the installation of a container.

The following disclosures may be relevant to various aspects of the present invention:

U.S. Pat. No. 5,500,719

Patentee: Ichakawa et al.

Issue Date: Mar. 19, 1996

U.S. Pat. No. 5,495,323

Patentee: Meetze

Issue Date: Feb. 27, 1996

U.S. Pat. No. 5,455,662

Patentee: Ichakawa et al.

Issue Date: Oct. 3, 1995

U.S. Pat. No. 5,446,478

Patentee: Larson

Issue Date: Aug. 29, 1995

U.S. Pat. No. 5,089,854

Patentee: Kaieda et al.

Issue Date: Feb. 18, 1992

U.S. Pat. No. 5,057,872

Patentee: Saijo et al.

Issue Date: Oct. 15, 1991

U.S. Pat. No. 4,990,964

Patentee: Kraehn

Issue Date: Feb. 5, 1991

U.S. Pat. No. 4,878,603

Patentee: Ikesue et al.

Issue Date: Nov. 7, 1989

The relevant portions of the foregoing disclosures may be briefly summarized as follows:

U.S. Pat. No. 5,500,719 discloses a developer replenishing device including a cylindrically shaped toner bottle having a mouth portion at the end of the bottle. The bottle has internal spiral ribs for advancing the toner to wards the mouth portion. A coil spring urges a sealing member against the mouth portion to seal the toner bottle.

U.S. Pat. No. 5,495,323 discloses a device for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

U.S. Pat. No. 5,455,662 discloses a developer replenishing device for replenishing a developing device with a developer and a developer container for use therewith. The developer container or toner bottle has a mouth portion at one end thereof which is smaller than in diameter than a hollow cylindrical main body. At the end of the bottle provided with the mouth, a shoulder has the inner periphery thereof partly raised to the edge of the mouth portion to form a raised portion for scooping up toner.

U.S. Pat. No. 5,446,478 discloses a development system for an electrographic printer. The development system includes a bellows for blowing toner particles toward a developer roller in the development system. The bellows uses spring bias provided from either a coil spring or a torsion spring.

U.S. Pat. No. 5,089,854 discloses a device for assisting the removal of toner from a toner bottle. The device includes a vertically oriented toner bottle having an opening formed in a cap portion at its lower end and a bellows which may be extended or shrunk by pushing the top portion of the toner bottle downward to eject toner in the bottle out of the bottle.

U.S. Pat. No. 5,057,872 discloses a developer supplying device which includes a substantially cylindrical developer container having on its peripheral surface a spiral groove and being able to rotate to transport a developer therein by the groove. The device includes a supplying element in the form of an opening and a regulating device.

U.S. Pat. No. 4,990,964 discloses toner delivery system including a toner bottle having an opening in the top end thereof. The toner is removed from the bottle by a vertically oriented suction spout to which a bellows is attacked for extracting the toner therefrom. A handle is located above the bellows and attached thereto to assist an operator in manually actuating the bellows U.S. Pat. No. 4,878,603 discloses a toner replenishing device for replenishing toner to a toner storage area, from where the toner is supplied to a developing section. The device includes a holder for releaseably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position and receiving the first mating member.

According to the present invention, there is provided a device for storing a supply of particles for use in a developer unit of an electrophotographic printing machine. The device includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

According to the present invention, there is also provided a developer unit for developing a latent image recorded on an image receiving member with a supply of particles. The developer unit includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

According to the present invention, there is further provided an electrophotographic copy machine for developing with a supply of particles a latent image recorded on an image receiving member. The copy machine including a developer unit. The developer unit includes an open ended container defining a chamber in communication with the open end thereof. The particles are stored in the chamber of the container. The device also includes a member cooperating with the container to urge the container in the direction of the open end. The member defines a longitudinal axis thereof. The member is collapsible in the direction of the longitudinal axis. The member includes a body defining a cavity therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
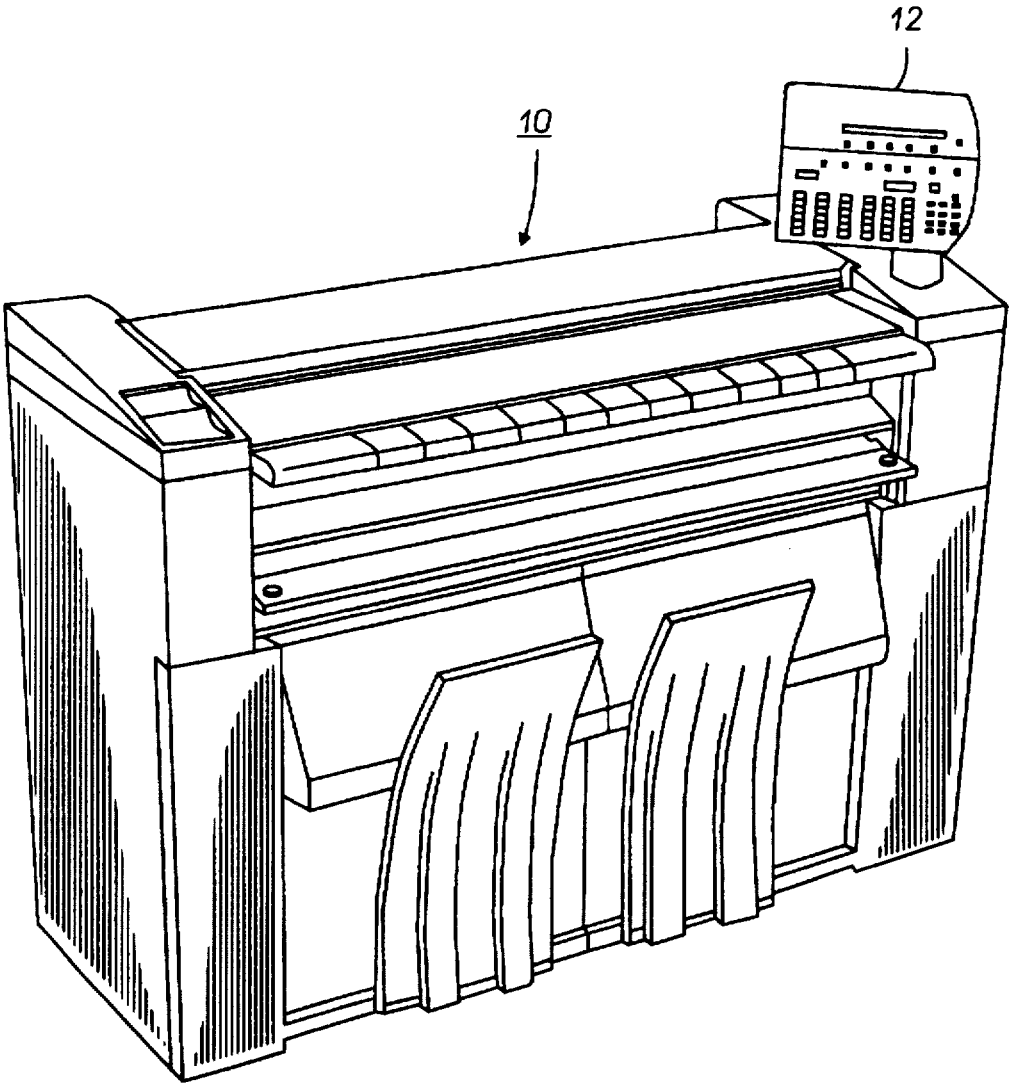
FIG. 2 is a schematic elevational view of an illustrative electrophotographic printing machine incorporating the molded spring biased toner bottle of FIG. 1.
Figure 3:
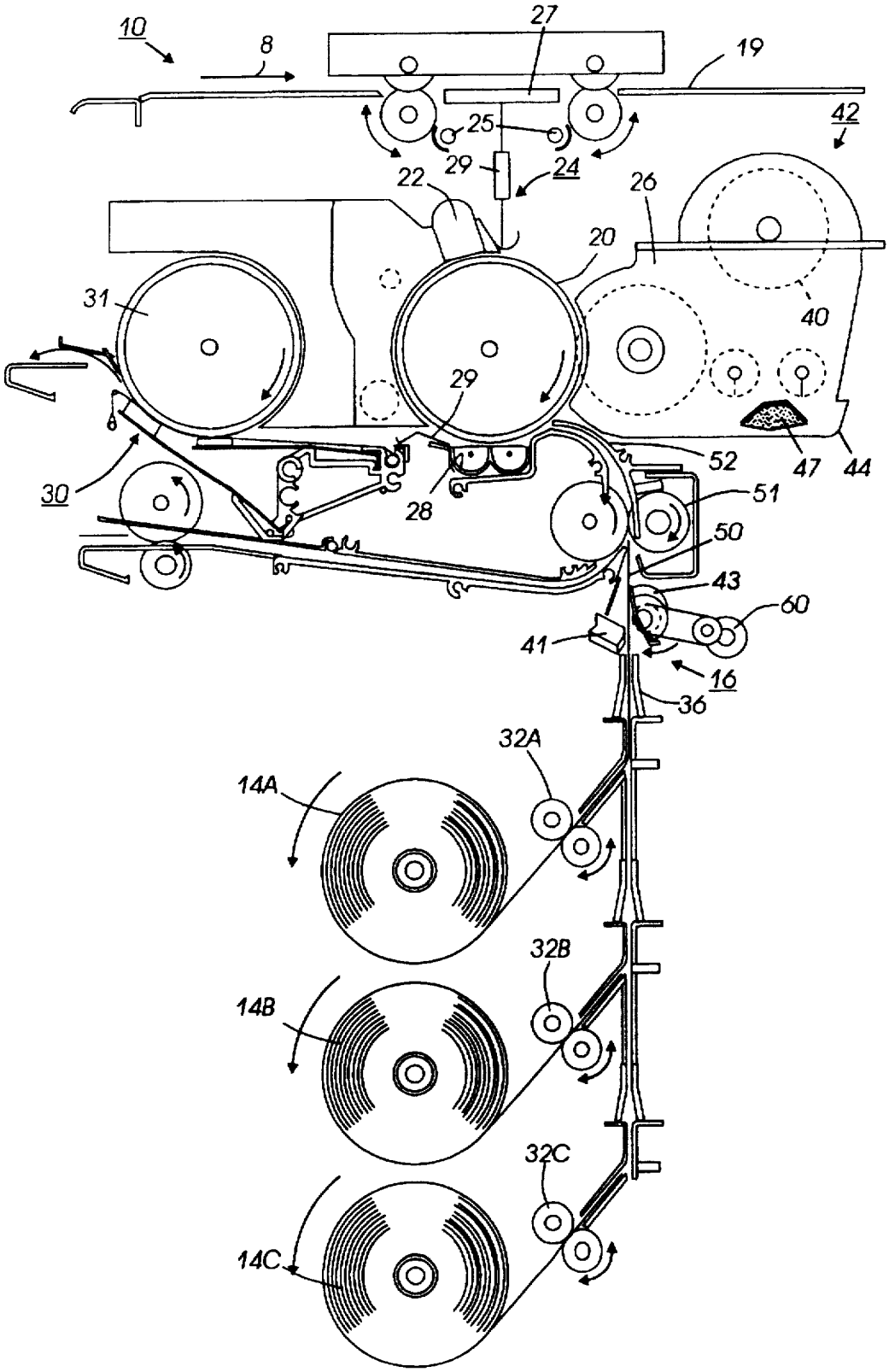
FIG. 3 is a partial schematic side view of the machine of FIG. 2 showing the position of the molded spring biased toner bottle of the present invention mounted onto the developer housing of FIG. 1.

Referring to FIGS. 2 and 3 of the drawings there is shown by way of example an automatic xerographic reproduction or printing machine, designated generally by the numeral 10 incorporating the post transfer corrugator structure of the present invention.

Referring now to the drawings in detail wherein like numbers represent like elements, in FIG. 2 a wide format copier/printer 10 including a control panel 12 is shown which is especially adapted to copy large documents. Documents to be copied are fed in from the front of the machine, pass through an exposure zone and exit out of the back of the machine.

FIG. 3 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30. Documents fed along the platen 19 in the direction of arrow 8 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from the selected media roll assembly 14A, 14B or 14C and is fed by a respective feed roller pair 32A, 32B or 32C. The sheet to be cut is guided along a vertical path between baffle pairs into the sheet cutting bar assembly 16 which includes a stationary blade 41 and a rotating cutting bar 43 that includes a helical cutting blade. Cutter bar 43 is shown in the home position which is about 30° of rotation away from the cutting position and is driven by motor 60. Cutter assembly 16 is of the conventional type described, for example, in U.S. Pat. No. 4,058,037. Initiated by a cutter operation signal, bar 43 rotates in the direction of the arrow with its blade moving against blade 41 to sheer a sheet 50 from the roll media with a straight cut. The cut sheet is transported after registration by roller pair 51 into baffle 52 and then into transfer station 28 where a developed image is transferred onto the sheet. The cut sheet is then forwarded over post transfer corrugator 29, through fuser 31 at fuser station 30 and out of the machine. It should be appreciated that the printing machine may likewise include a photoreceptor in the form of a belt (not shown) in place of the drum 20. The drum 20 has a photoconductive surface layer 12 on an electroconductive substrate 14. Preferably the surface 12 is made from a selenium alloy. The substrate 14 is preferably made from an aluminum alloy which is electrically grounded. The drum is driven by means of motor(not shown), the direction of movement being clockwise as viewed and as shown by arrow 16. Initially a portion of the drum 20 passes through a charge station 22 at which a corona generator (not shown) charges surface 12 to a relatively high, substantially uniform, potential.

Next, the charged portion of photoconductive surface 12 is advanced through exposure station 24. At exposure station 24, imaging of the document is achieved by lamps 25 which illuminate the document on a platen 27. Light rays reflected from the document are transmitted through the lens 29. Lens 29 focuses light images of the document onto the charged portion of the photoconductive drum 20 to selectively dissipate the charge thereon. This records an electrostatic latent image on the photoconductive belt which corresponds to the informational areas contained within the original document. Thereafter, drum 20 advances the electrostatic latent image recorded thereon to development station 26.

After the electrostatic latent image has been recorded on photoconductive surface 12, drum 20 advances the latent image to development station 26 as shown in FIG. 2. The development station 26 develops the latent image recorded on the photoconductive drum 20. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 3, after the electrostatic latent image has been developed, drum 20 advances the developed image to transfer station 28, at which a copy sheet is advanced by rollers 51 and baffle 52 into contact with the developed image on drum 20. A corona generator is used to spray ions onto the back of the sheet so as to attract the toner image from drum 20 onto the sheet. As the drum 20 turns, the sheet is stripped therefrom with the toner image thereon.

After transfer, the sheet is advanced by a conveyor (not shown) to fusing station 30. Fusing station 30 includes a heated fuser 31. The sheet passes fuser roller 31 with the toner powder image contacting fuser roller 31. In this way, the toner powder image is permanently affixed to the sheet. After fusing, the sheet advances for subsequent removal from the printing machine by the operator.

After the sheet is separated from photoconductive surface 12 of drum 20, the residual toner particles adhering to photoconductive surface 12 are removed therefrom at cleaning station (not shown) by a rotatably mounted fibrous brush in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
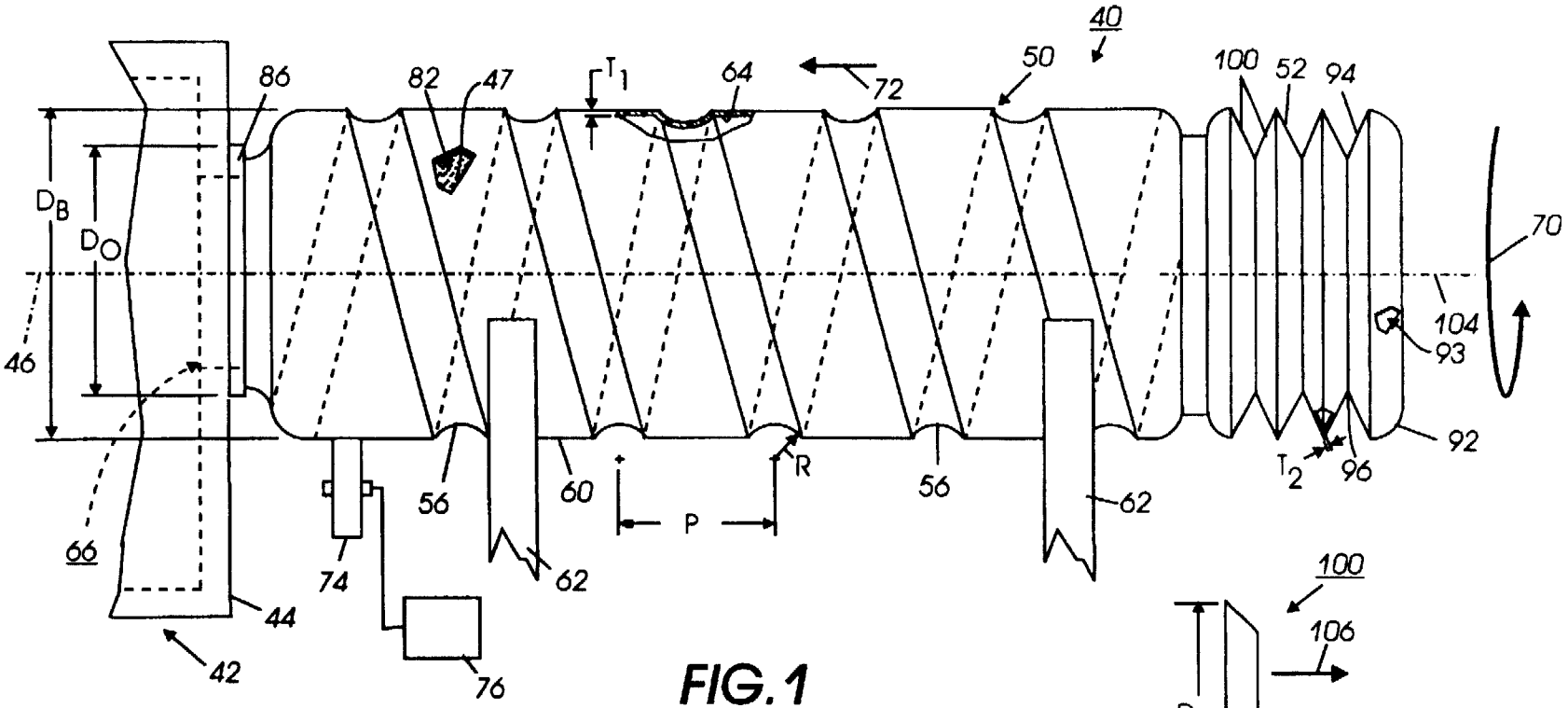
FIG. 1 is a plan view showing the molded spring biased toner bottle of the present invention mounted onto a developer housing.

According to the present invention and referring to FIG. 1, a particle storage device 40 is shown. The particle storage device 40 is located within the developer unit 42 and is secured to developer housing 44. The particle storage device 40 is positioned relative to the horizontal such that longitudinal axis 46 of the device 40 is located horizontally. The device 40 includes an open ended container 50 as well as a member 52 to urge the open ended container 50 against the developer housing 44.

The open ended container 50 may have any suitable shape and configuration capable of containing the marking particles 47. For example, the container 50 may have a generally cylindrical shape and contain within the hollow container 50 a spirally shaped spring or auger (not shown) for urging the marking particles 47 within the container 50 toward the developer housing 44. Preferably, however, the container 50 includes spiral ribs 56 formed in periphery 60 of the container 50. Such a container with integral spiral ribs is disclosed in U.S. Pat. No. 5,495,323 to Meetze, Jr., the relative portions thereof incorporated herein by reference.

The container 50 is preferably supported by supports 62 in the form of a V or similarly shaped cradle 62. The container 50 may thus be replaced by lifting the container 50 in a vertical direction away from the cradle 62.

The spiral ribs 56 are located on internal periphery 64 of the container 50 to urge the marking particles 54 toward open end 66 of the container 50. The container 50 is rotated in the direction of arrow 70 whereby the spiral ribs 56 progress the particles 47 in the direction of arrow 72. The container 50 is rotated by any suitable method, i.e. by drive wheel 74 located on outer periphery 60 of the container. The drive wheel 74 may be rotated by any suitable method, i.e. by drive mechanism 76.

Figure 4:
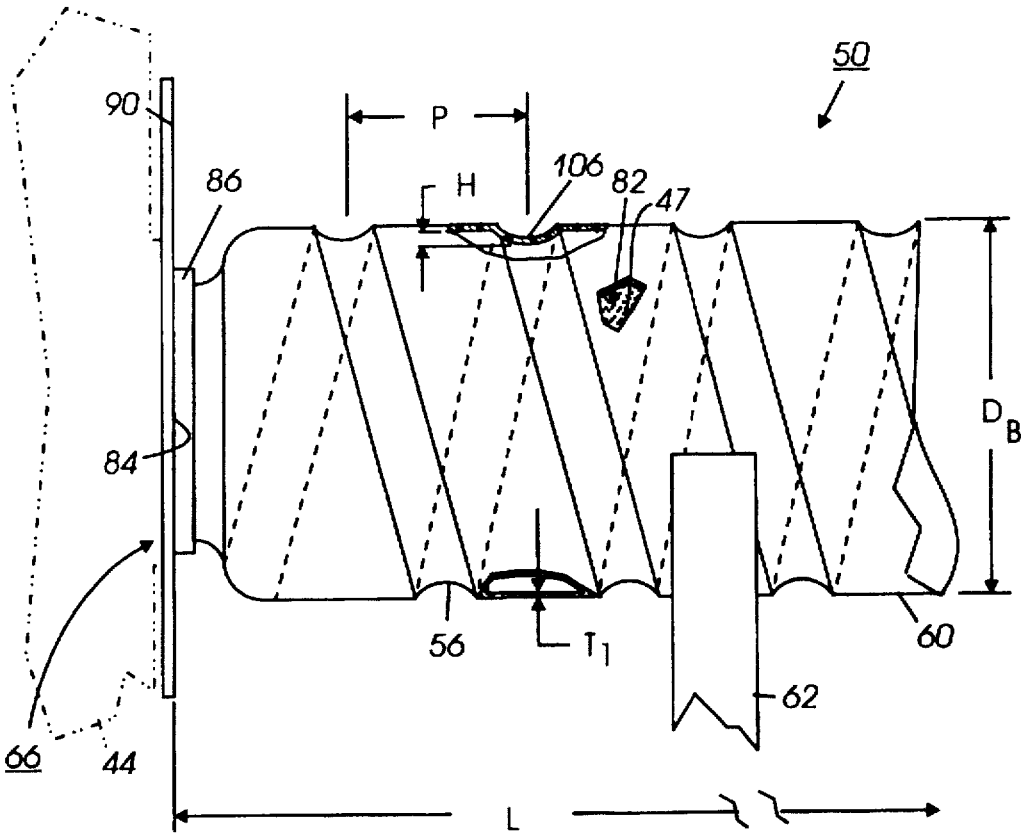
FIG. 4 is a partial plan view of the FIG. 1 molded spring biased toner bottle showing the sealing of the bottle in greater detail.

Referring now to FIG. 4, the container 50 is shown in greater detail. The container 50 may have any suitable size necessary to store a sufficient quantity of marking particles 47 within chamber 82 of the container 50. For example, the container 50 may have a length L of approximately 6 , inches and a diameter $D_B$ across the external periphery 60 of the container 50 of approximately 3 inches.

The ribs 56 form an internal protrusion or height H along which the particles 47 progress. The height H may be any suitable height necessary to translate sufficient quantities of marking particles 47 toward open end 66 of the container 50. For example, the height H may be approximately 0.2 inches. To provide for a sufficient quantity of particles 47 progressing toward the open end 66 of the container, the pitch P or distance between adjacent ribs 56 may be adjusted to provide for a larger or smaller quantity of particles 47 moving toward the open end 66. For example, the pitch P may be approximately 1 inch.

The container 50 may be made of any suitable durable material and may for example be made of acetal or polyethylene. The container 50 may likewise be made of a glass filled polycarbonate for increased strength. When made of acetal or polyethylene, the container 50 may have a thickness T sufficient to maintain the strength of the container 50, for example, the thickness T may be approximately 0.020 to 0.050 inches.

The container 50 may be made by any suitable method, for example, the container 50 may be blow molded by a suitable blow molding process. Such a process is described in U.S. Pat. No. 4,101,617 to Friedrich, the relative portions thereof incorporated herein by reference.

To provide sufficient sealing of the container 50 against face 84 of the developer housing, seal 86 is positioned between face 84 and open end 66 of the container 50. The seal 86 may be made of any suitable durable resilient material, i.e. the seal 86 may be made of a resilient foam, for example polypropylene.

To provide for a temporary sealing of the marking particles 54 within the container 50 during shipment installation, the container 50 may have the open end 66 thereof covered by a removable cover 90 adhesively applied to the seal 86. The cover 90 may be made of any suitable material that is preferably gas permeable. For example, TYVEC®, a product of E. I. duPont de Nemours and Company, is suitable for this purpose.

Referring again to FIG. 1, according to the present invention, the particle storage device 40 further includes the member 52. The member 52 may have any suitable shape and configuration capable of urging the container 50 in the direction of arrow 72 whereby the container 50 is properly secured to the developer housing 44 so that seal 86 may be sufficiently compressed to provide for adequate sealing.

The member 52 includes a body 92. The body 92 defines a cavity 93 within the body 92. The body 92 has a thickness $T_2$ between outer periphery 94 and inner periphery 96 of the body 92. The member 52 may have any suitable shape capable of providing a collapsing or movement of the member 52 in the direction of arrow 72. For example, the member 52 may have a torodial shape, a spherical shape or any other shape that when compressed would provide for a force against the container 50 in the direction of arrow 72. Preferably, the member 52 includes a disk shaped segment 100 to provide for a bellows or spring configuration which is readily collapsible in the longitudinal axis 46.

The spring 52 may be made of any suitable durable material but preferably is made of a plastic, for example, acetal or polyethylene. Because of its material properties, polypropylene is preferred for the spring 52. The body 92 defines cavity 93 within inner periphery 96 of the body 92. The inner periphery 96 and outer periphery 94 define thickness $T_2$ of the body 92. The thickness T2 may be any suitable thickness to obtain the proper force for the sealing of the seal 86. For example, applicant has found that a thickness T2 of approximately 0.020 inches when polypropylene is used is sufficient.

Preferably, the spring 52 and the container 50 are made of identical materials and preferably are molded integrally to each other within the same mold in a blow molding process. Such a process serves to reduce the cost of the container 50 and the spring 52 as well as to prevent the loss or misplacement of the spring 52. Removal and reassembly of a separable spring is also avoided by the use of an integral spring. The spring 52 preferably has a longitudinal axis 104 which is coincident with the longitudinal 46 of the container 50.

Figure 1A:
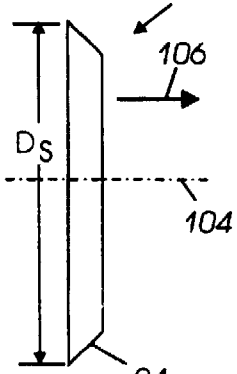
FIG. 1A is a partial plan view showing a segment of the molded spring of FIG. 1.

Referring now to FIG. 1A, a segment 100 is shown relative to spring axis 104. The segment 100 has a generally conofrustrical shape. Outer periphery 94 of the segment 100 defines diameter $D_s$. Diameter $D_s$ decreases in the direction of arrow 106, arrow 106 being parallel to conofrustrical axis 104.

Figure 5A:
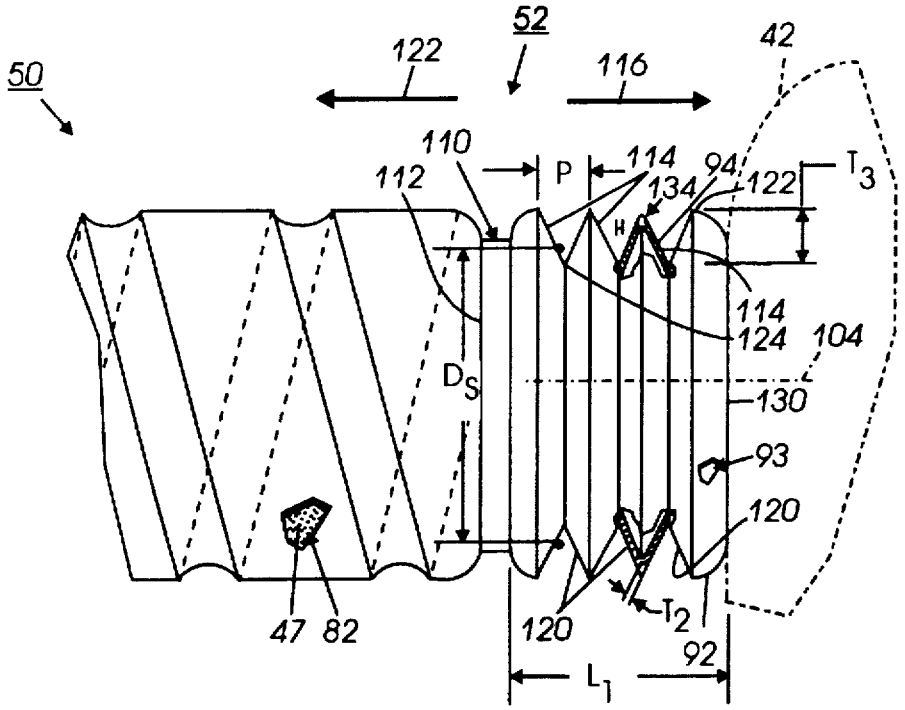
FIG. 5A is a partial plan view of the FIG. 1 molded spring biased toner bottle in a compressed state.
Figure 5B:
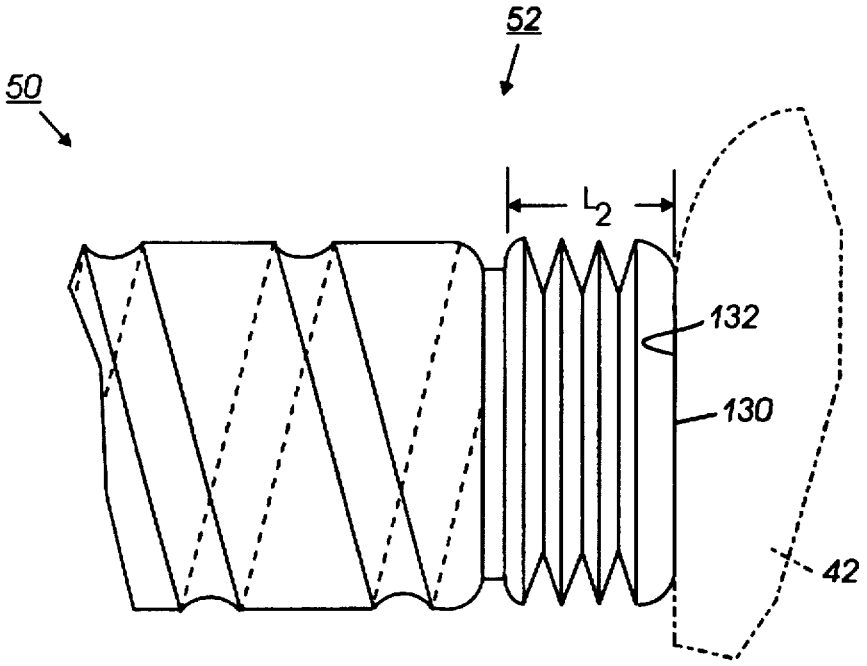
FIG. 5 is a partial plan view of the FIG. 1 molded spring biased toner bottle in a relaxed state showing the molded spring in greater detail.

The spring 52 is shown in greater detail in FIG. 5. While the invention may be practiced with chamber 82 and cavity 93 being coincident, preferably, cavity 93 is separated from chamber 82 by pinch-off area 110. Pinch-off area 110 forms a wall 112 between cavity 93 and chamber 82.

By providing wall 112, marking particles 54 will not be trapped within the spring 52. Pinch-off area 110 may be provided by any suitable manufacturing technique. Where the container 50 and the spring 52 are integrally molded in the same mold, the pinch-off area 110 may be accomplished by progressive movement of the die toward the pinch-off area.

Preferably the spring 52 is made from a series of conofrustrical segments 100. These segments preferably include a first set of segments 114 and a second set of segments 120. The diameter $D_s$ of the periphery 94 of each segment 100 of the first set of segments 114 decreases in a first direction of arrow 116 along the conofrustrical axis 104 of the spring 52. The diameter $D_s$ of the periphery 94 of each segment 100 of the second set of segments 120 decreases in a second direction of arrow 122 along the conofrustrical axis 114 opposed to the first direction of arrow 116. Each of the segments 100 in the first set of segments 114 are interposed between adjacent segments 100 of the second set of segments 120. Adjacent segments 100 of each set of segments are separated by a distance or pitch P. The diameter $D_s$ has a maximum value at crest 122 of the spring 52 and a minimum dimension at root 124 of the spring 52. The distance between the crest 122 and the root 124 describes a thread thickness $T_3$. The selection of the material for the spring 52, the selection of a thickness $T_2$ of the spring, a selection of the thread thickness $T_3$, a selection of the diameter $D_s$ of the spring 52 as well as the selection of the pitch P provides for a spring constant K for the spring 52.

The spring 52 is capable of providing a spring force defined by the following formula:

$$F=KX$$

where:

K equals spring constant, defined in pounds per inch; and

X equals the displacement of the spring in inches.

As shown in FIG. 5, the spring 52 has a relaxed length L1 from the wall 112 to closed end 130 of spring 52.

Referring now to FIG. 5A, the spring 52 is shown in a compressed state. The spring 52 is compressed against surface 132 of developer unit 42. When compressed, the spring 52 has a compressed length L2 which is less than the relaxed length L1 of the spring 52 (see FIG. 5). Applicant has found that a length L2 of approximately 85% of length L1 is sufficient to provide enough spring force to properly seat the seal 86 against developer housing 44 (see FIG. 1). The distance L2 subtracted from the distance L1 provides for a dimension X to be used in the above mentioned formula.

Referring again to FIG. 5, to provide for the collapsing of the spring 52, preferably the spring 52 includes a opening 134 in the periphery 94 of the spring 52. The opening or aperture 134 provides for air passage from cavity 102 to permit the excess air to escape when the spring 52 is collapsed. Permitting this excess air to escape will reduce the force necessary to collapse the spring. The aperture 132 may have any suitable size, for example, may be as small as 0.05 inches. The aperture 134 may be inherently provided by the removal of a gas injection nozzle (not shown) during the molding operation. The nozzle is used to inject the gas into the cavity 93 to form the spring 52.

Figure 6:
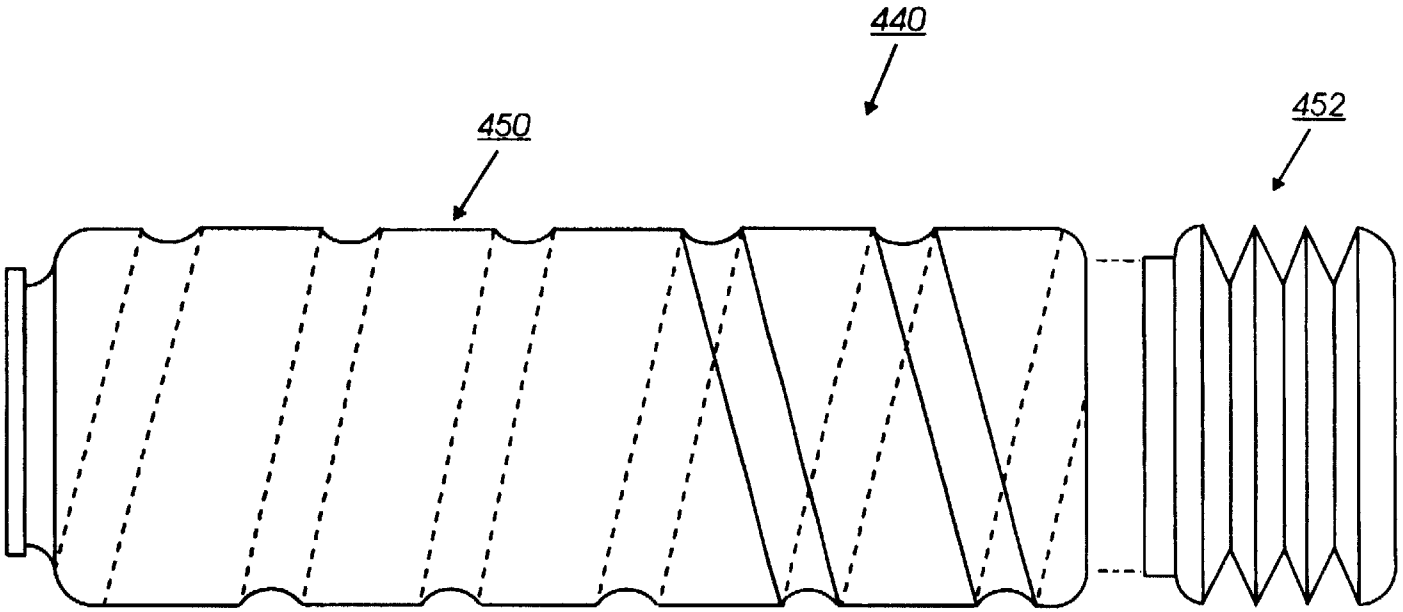
FIG. 6 is a plan view of a second embodiment of a molded spring biased toner bottle according to the present invention including a separate molded spring.

While the particle storage device may include an integral container 50 to be used with a spring 52, as shown in FIGS. 1–5, the particle storage device may, as shown in FIG. 6, provide for separate containers and springs.

Referring now to FIG. 6, a particle storage device 440 is shown. Particle storage device 440 includes a open end container 450 similar to container 50 of FIG. 1 as well as a separate spring 452 which is similar to spring 52 of FIG. 1. Spring 452, unlike spring 52 of FIG. 1, is a separable piece from container 450. The container 450 and the spring 452 may be made of distinct materials or preferably be molded of the same material within the same molding machine in different portions of the molding machine die cavity.

By providing a particle storage device including a hollow urging member integrally molded with a container, a simple inexpensive member can be provided which will not need to be separately removed during replacement of the container and thus not possibly lost.

By providing a spring member having a bellows shaped spring, an accurate and well controllable spring force may be provided for the urging member.

By providing a container and spring integrally molded in a blow molding process, a simple inexpensive container may be provided with an urging member to simply and inexpensively seal the open end of the container against the developer housing.

By providing a spring member made from a hollow member with an external aperture, a spring member may be provided which has a readily controllable spring rate.

By providing a molded spring member with a pinch-off area between the spring member and the container, a container may be provided which may be sufficiently emptied and yet be integral with a molded spring.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A device for storing a supply of particles for use in a developer unit of an electrophotographic printing machine, comprising:

an open ended container defining a chamber in communication with the open end thereof with the particles being stored in the chamber of said container, the open end of said container positionable adjacent the developer unit for passage of the particles into the developer unit; and a plastic member cooperating with said container to urge the container in the direction of the open end, said member defining a longitudinal axis thereof, said member including a resilient peripheral wall thereof, said member being resiliently collapsible in the direction of the longitudinal axis, said member including a body defining a cavity therein, the resiliency of said peripheral wall urging the periphery of the container adjacent the open end toward the developer unit.

2. A device according to claim 1, wherein the body of said member comprises a plurality of disk shaped segments thereof, at least one of the segments having a conofrustrical shape defining a conofrustrical longitudinal axis thereof, the first mentioned longitudinal axis and the conofrustrical axis be coincident.

3. A device according to claim 2, wherein the segments comprise a first set of segments and a second set of segments, the diameter of the periphery of each segment of the first set of segments decreasing in a first direction along the conofrustrical axis and the diameter of the periphery of each segment of the second set of segments decreasing in a second direction along the conofrustrical axis, opposed to the first direction, each of the segments in said first set of segments being interposed between adjacent segments of the second set of segments.

4. The device according to claim 1 wherein the body of said member defines a aperture therethrough for dispelling air when said member is collapsed.

5. A device for storing a supply of particles for use in a developer unit of an electrophotographic printing machine, comprising:

an open ended container defining a chamber in communication with the open end thereof with the particles being stored in the chamber of said container; and a plastic member cooperating with said container to urge the container in the direction of the open end, said member defining a longitudinal axis thereof, said member resiliently collapsible in the direction of the longitudinal axis, said member including a body defining a cavity therein, said container and said member having a one-piece construction.

6. A device according to claim wherein the body of said member comprises a plurality of disk shaped segments thereof, at least one of the segments having a conofrustrical shape defining a conofrustrical longitudinal axis thereof, the first mentioned longitudinal axis and the conofrustrical axis be coincident, wherein the segments comprise a first set of segments and a second set of segments, the diameter of the periphery of each segment of the first set of segments decreasing in a first direction along the conofrustrical axis and the diameter of the periphery of each segment of the second set of segments decreasing in a second direction along the conofrustrical axis, opposed to the first direction, each of the segments in said first set of segments being interposed between adjacent segments of the second set of segments.

7. A device according to claim 5, wherein said member and said container define a wall therebetween, said wall cooperating with said container to define the chamber and said wall cooperating with said member to define the cavity.

8. A device for storing a supply of particles for use in a developer unit of an electrophotographic printing machine, comprising:

an open ended container defining a chamber in communication with the open end thereof with the particles being stored in the chamber of said container; and a plastic member cooperating with said container to urge the container in the direction of the open end, said member defining a longitudinal axis thereof, said member resiliently collapsible in the direction of the longitudinal axis, said member including a body defining a cavity therein, further comprising a spiral rib formed on an internal periphery of said container for urging the marking particles in the chamber toward the open end of said chamber.

9. A developer unit for developing a latent image recorded on an image receiving member with a supply of particles, said developer unit comprising:

an open ended container defining a chamber in communication with the open end thereof with the particles being stored in the chamber of said container, the open end of said container positionable adjacent the developer unit for passage of the particles into the developer unit; and a plastic member cooperating with said container to urge the container in the direction of the open end, said member defining a longitudinal axis thereof, said member including a resilient peripheral wall thereof, said member being resiliently collapsible in the direction of the longitudinal axis, said member including a body defining a cavity therein, the resiliency of said peripheral wall urging the periphery of the container adjacent the open end toward the developer unit.

10. A developer unit according to claim 9, wherein the body of said member comprises a plurality of disk shaped segments thereof, at least one of the segments having a conofrustrical shape defining a conofrustrical longitudinal axis thereof, the first mentioned longitudinal axis and the conofrustrical axis be coincident.

11. A developer unit according to claim 10, wherein the segments comprise a first set of segments and a second set of segments, the diameter of the periphery of each segment of the first set of segments decreasing in a first direction along the conofrustrical axis and the diameter of the periphery of each segment of the second set of segments decreasing in a second direction along the conofrustrical axis, opposed to the first direction, each of the segments in said first set of segments being interposed between adjacent segments of the second set of segments.

12. The developer unit according to claim 9 wherein the body of said member defines a aperture therethrough for dispelling air when said member is collapsed.

13. A developer unit for developing a latent image recorded on an image receiving member with a supply of particles, said developer unit comprising:

an open ended container defining a chamber in communication with the open end thereof with the particles being stored in the chamber of said container; and a plastic member cooperating with said container to urge the container in the direction of the open end, said member defining a longitudinal axis thereof, said member resiliently collapsible in the direction of the longitudinal axis, said member including a body defining a cavity therein, said container and said member having a one-piece construction.

14. A developer unit according to claim 11, wherein the body of said member comprises a plurality of disk shaped segments thereof, at least one of the segments having a conofrustrical shape defining a conofrustrical longitudinal axis thereof, the first mentioned longitudinal axis and the conofrustrical axis be coincident, wherein the segments comprise a first set of segments and a second set of segments, the diameter of the periphery of each segment of the first set of segments decreasing in a first direction along the conofrustrical axis and the diameter of the periphery of each segment of the second set of segments decreasing in a second direction along the conofrustrical axis, opposed to the first direction, each of the segments in said first set of segments being interposed between adjacent segments of the second set of segments.

15. A developer unit according to claim 13, wherein said member and said container define a wall therebetween, said wall cooperating with said container to define the chamber and said wall cooperating with said member to define the cavity.

16. A developer unit for developing a latent image recorded on an image receiving member with a supply of particles, said developer unit comprising:

an open ended container defining a chamber in communication with the open end thereof with the particles being stored in the chamber of said container; and a plastic member cooperating with said container to urge the container in the direction of the open end, said member defining a longitudinal axis thereof, said member resiliently collapsible in the direction of the longitudinal axis, said member including a body defining a cavity therein, further comprising a spiral rib formed on an internal periphery of said container for urging the marking particles in the chamber toward the open end of said chamber.

17. An electrophotographic printing machine for developing with a supply of particles a latent image recorded on an image receiving member, said printing machine including a developer unit comprising:

an open ended container defining a chamber in communication with the open end thereof with the particles being stored in the chamber of said container, the open end of said container positionable adjacent the developer unit for passage of the particles into the developer unit; and a plastic member cooperating with said container to urge the container in the direction of the open end, said member defining a longitudinal axis thereof, said member including a resilient peripheral wall thereof, said member being resiliently collapsible in the direction of the longitudinal axis, said member including a body defining a cavity therein, the resiliency of said peripheral wall urging the periphery of the container adjacent the open end toward the developer unit.

18. A printing machine according to claim 17, wherein the body of said member comprises a plurality of disk shaped segments thereof, at least one of the segments having a conofrustrical shape defining a conofrustrical longitudinal axis thereof, the first mentioned longitudinal axis and the conofrustrical axis be coincident.

19. A printing machine according to claim 18, wherein the segments comprise a first set of segments and a second set of segments, each segments of the first set of segment being disposed in a first direction along the conofrustrical axis and each segments of the second set of segment being disposed in a second direction along the conofrustrical axis, opposed to the first direction, each of the segments in said first set of segments being interposed between adjacent segments of the second set of segments.

20. The printing machine according to claim 17 wherein the body of said member defines a aperture therethrough for dispelling air when said member is collapsed.

21. An electrophotographic printing machine for developing with a supply of particles a latent image recorded on an image receiving member, said printing machine including a developer unit comprising:

an open ended container defining a chamber in communication with the open end thereof with the particles being stored in the chamber of said container; and a plastic member cooperating with said container to urge the container in the direction of the open end, said member defining a longitudinal axis thereof, said member resiliently collapsible in the direction of the longitudinal axis, said member including a body defining a cavity therein, said container and said member having a one-piece construction.

22. A printing machine according to claim 21 wherein the body of said member comprises a plurality of disk shaped segments thereof, at least one of the segments having a conofrustrical shape defining a conofrustrical longitudinal axis thereof, the first mentioned longitudinal axis and the conofrustrical axis be coincident, wherein the segments comprise a first set of segments and a second set of segments, the diameter of the periphery of each segment of the first set of segments decreasing in a first direction along the conofrustrical axis and the diameter of the periphery of each segment of the second set of segments decreasing in a second direction along the conofrustrical axis, opposed to the first direction, each of the segments in said first set of segments being interposed between adjacent segments of the second set of segments.

23. A printing machine according to claim 21, wherein said member and said container define a wall therebetween, said wall cooperating with said container to define the chamber and said wall cooperating with said member to define the cavity.

24. An electrophotographic printing machine for developing with a supply of particles a latent image recorded on an image receiving member, said printing machine including a developer unit comprising an open ended container defining a chamber in communication with the open end thereof with the particles being stored in the chamber of said container; and a plastic member cooperating with said container to urge the container in the direction of the open end, said member defining a longitudinal axis thereof, said member resiliently collapsible in the direction of the longitudinal axis, said member including a body defining a cavity therein, further comprising a spiral rib formed on an internal periphery of said container for urging the marking particles in the chamber toward the open end of said chamber.

* * * * *